United States Patent [19]

Amrhein

[11] 4,326,484

[45] Apr. 27, 1982

[54] FLOATING TAPPET GUIDE PLATE

[75] Inventor: Earl F. Amrhein, Greensburg, Ind.

[73] Assignee: Cummins Engine Company, Inc., Columbus, Ind.

[21] Appl. No.: 88,561

[22] Filed: Oct. 26, 1979

[51] Int. Cl.[3] ..... F01L 1/14

[52] U.S. Cl. ..... 123/90.5; 123/302

[58] Field of Search ..... 123/90.48, 90.50, 302, 123/308, 315, 432, 508, 55 VE; 74/569

[56] References Cited

U.S. PATENT DOCUMENTS

| | | | |
|---|---|---|---|
| 1,726,513 | 8/1929 | Johnson | 123/90.48 |
| 1,802,330 | 4/1931 | Boland | 123/90.1 |
| 2,846,988 | 8/1958 | Iskenderian | 123/90.1 |
| 3,089,472 | 5/1963 | Thompson | 123/90.1 |
| 3,108,580 | 10/1963 | Crane, Jr. | 123/90.5 |
| 3,180,328 | 4/1965 | Engle | 123/90.5 |
| 3,668,945 | 6/1972 | Hofmann | 123/90.5 |
| 3,791,355 | 2/1974 | Bergmann et al. | 123/90.5 |

*Primary Examiner*—Craig R. Feinberg
*Assistant Examiner*—W. R. Wolfe
*Attorney, Agent, or Firm*—Sixbey, Friedman & Leedom

[57] ABSTRACT

A floating tappet guide plate (60) is provided for an internal combustion engine having three tappets (40, 42, 44) per cylinder wherein the guide plate (60) is mounted for movement on the central tappet (40) and is shaped to cooperate with mating surfaces on the remaining tappets to prevent rotation of all three tappets. The tappet guide plate (60) is secured to the circumference of the injector tappet (40) so as to form an integral part thereof and includes opposed squared projections (64) and (66) which extend toward and approximate corresponding flat guide surfaces (50) and (51) of valve tappets (42) and (44), thus permitting the valve tappets to move freely in a vertical direction while simultaneously preventing their rotation and maintaining all three tappets substantially aligned about their central longitudinal axes.

15 Claims, 4 Drawing Figures

FLOATING TAPPET GUIDE PLATE

TECHNICAL FIELD

The present invention relates generally to internal combustion engines and, more specifically, to a floating tappet guide plate for use with valve and injector tappets in a diesel engine.

BACKGROUND ART

Tappets in an internal combustion engine function to transmit the rotational movement of the engine camshaft into the linear movement needed to move the pushrods and rocker levers which actuate fuel injectors and intake and exhaust valves. Many different types of tappets are known which perform this function. One type of tappet widely used in internal combustion engines today, which may be called a roller-type tappet, includes a roller mechanism at one end for reducing frictional losses between the tappet and the associated cam surface on the camshaft. It has long been recognized that proper alignment of the tappets with respect to the camshaft and pushrods and maintenance of this alignment is essential to the efficient operation of the engine. However, there is a tendency for roller type tappets to rotate during engine operation and become misaligned, which may result in cam and tappet failures. Replacement or repair of these engine components is an extremely lengthy procedure since much of the engine must be disassembled to allow access to the tappets and cams. Moreover, such a process is very costly to the manufacturer if the engine is still under warranty or to the engine owner if the warranty is no longer in effect.

There have been many suggestions made for ways to maintain proper tappet alignment and prevent rotation of roller type tappets during engine operation. While these suggestions superficially appear to be simple solutions to the problem, a closer look reveals that they are in reality complex and accompanied by problems. One early approach was to provide a tappet and corresponding hole in the engine block in a square shape, so that tappet rotation and misalignment was not likely to occur. However, providing a square hole in the engine block and a square tappet to fit in it is both difficult and costly.

A second approach is exemplified by U.S. Pat. Nos. 1,802,330 and 3,089,472, which disclose a housing mounted in the engine block which receives the body of the tappet. U.S. Pat. No. 1,802,330 specifically discloses a mating cylindrical housing with the tappet slidably mounted in the bore of the housing which maintains the tappet in alignment. A pin inserted through slots in a pair of adjacent tappets holds them against rotation. The structure disclosed in U.S. Pat. No. 3,089,472 includes an alignment plate which can be temporarily or permanently fastened to the engine block to achieve the desired alignment of a pair of tappets in their housings. Once this is achieved, the rollers at the ends of the tappets which engage the cam and transmit movement to the pushrods should be properly aligned and unlikely to rotate. Both of the aforementioned structures are fairly effective in preventing tappet rotation. However, the utilization of such tappet housings increases the number of engine parts subject to costly repair or replacement. In addition, the cost associated with the additional machining required to bore these tappet housings makes this solution to the problem of maintaining optimum tappet alignment an expensive one.

More simplified structures, such as the ones disclosed in U.S. Pat. Nos. 2,846,988 and 3,108,580, which eliminate the tappet housing and provide elements to prevent rotation have been proposed to maintain tappet alignment. Openings in the engine block guide the vertical movement of the tappets, thus eliminating the need for a tappet housing, and two adjacent tappets are prevented from rotating by the use of an antirotational device. The device disclosed in U.S. Pat. No. 2,846,988 includes two offset metal stampings and a flat piece which are fitted together and inserted into corresponding slots in two adjacent tappets. However, the clearance between the portions of these three pieces required to assemble the antirotational device and still permit vertical tappet movement may be sufficient to permit some rotation of the tappets and, subsequently, misalignment. Furthermore, the requirement for the three separate pieces which form this device, two of which must be precisely stamped to achieve the desired result, adds to the cost of manufacturing, assembling and replacing such a device. The means for preventing tappet rotation disclosed in U.S. Pat. No. 3,108,580 comprises an alignment bar or plate which is secured to the engine block and includes projections shaped to extend around approximately three quarters of the circumferences of two adjacent tappets, preventing the rotation thereof as they are guided upward through the engine block. Although such a structure adequately serves the desired purpose, the manner in which it is fastened to the engine block requires four separate attaching elements, creating a substantial assembly problem and, as with the other structures already discussed, adding significantly to the cost.

The assignee of the present invention currently utilizes an antirotational tappet guide plate which is secured to the engine block by two capscrews. However, maintaining the tolerance for the tappet guide screw holes within required limits during machining of the engine block is difficult and if not done properly results in the failure of the guide plate to prevent tappet rotation. Moreover, the time required on the assembly line to apply the washers and capscrews which secure the guide plate and then torque these screws is longer than is desirable.

DISCLOSURE OF THE INVENTION

It is the purpose of this invention to provide a structure which promotes the alignment and prevents the rotation of tappets in an internal combustion engine which overcomes the drawbacks of the prior art as discussed above. In particular it is an object of the present invention to provide simplified structure which effectively prevents rotation and maintains alignment of valve and injector tappets while permitting simple and inexpensive manufacture and assembly.

Still another object of the present invention is to provide a tappet guide structure which becomes an integral part of the injector tappet, thus eliminating the need for means to secure it to the engine block, and which moves independently of the intake and exhaust tappets while simultaneously maintaining the alignment and preventing the rotation thereof.

A further object of the present invention is to provide a tappet guide structure which effectively reduces tappet and cam failures due to misalignment and may be used advantageously in new and existing engines.

In accordance with the present invention a guide plate is provided for the tappets in an internal combustion engine which guide plate is secured to a central injector tappet so as to become an integral part thereof and includes opposed squared off extension legs which mate with the flat side portions of adjacent intake and exhaust valve tappets and provide sufficient clearance to allow the tappets to move freely in a vertical direction while preventing the rotation thereof. The novel structure of the tappet guide of the present invention maintains proper alignment and prevents rotation of valve and injector tappets and thus promotes trouble-free tappet and cam operation. Moreover, attaching the tappet guide to the central injector tappet eliminates the need for means to secure the guide to the engine block. Further, the simplicity of the tappet guide structure of the present invention permits it to be manufactured and assembled easily and at significantly lower cost than heretofore known tappet guides.

BRIEF DESCRIPTION OF THE DRAWINGS

The details of the present invention will be described in connection with the accompanying drawings, in which.

BEST MODE FOR CARRYING OUT THE INVENTION

Figure 1:
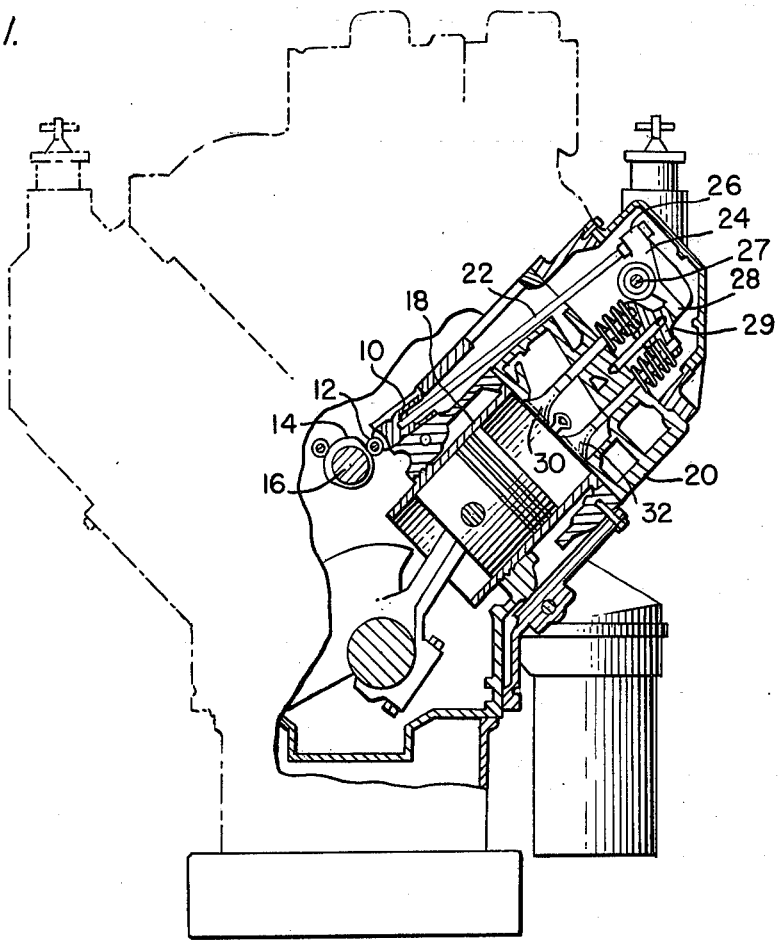
FIG. 1 is a fragmentary cross sectional view of a portion of an internal combustion engine showing the location of a valve tappet relative to the camshaft and valve.

To facilitate a better understanding of the tappet guide plate of the present invention, those portions of the internal combustion engine illustrated in FIG. 1 will be briefly described. Although only one tappet 10 is shown in the view of the engine illustrated in FIG. 1, each cylinder in this type of engine includes three tappets, a central tappet for the fuel injector and two adjacent valve tappets associated with a pair of valve trains for operating intake and exhaust valves, respectively. Tappet 10 (which is a valve tappet) includes at one end a roller 12 which engages cam 14 on camshaft 16 rotatably mounted within engine block 18. Rotation of camshaft 16 will cause tappet 10 to move linearly in a substantially outward direction away from camshaft 16 toward the engine head 20. This movement of the tappet causes pushrod 22, one end of which fits into the end of tappet 10 opposite roller 12, to move in the same direction. The other end of pushrod 22 engages rocker arm 24 at end 26 thereby causing the rocker arm 24 to rotate about its pivot axis 27. This causes end 28 of rocker arm 24 to move inwardly and act on the cross-head assembly 29, engaging the stems of poppet valves 30 and 32, causing them to open. Further rotation of camshaft 16 will cause roller 12 of tappet 10 to engage a portion of cam 14 which has a decreasing radial extent thereby causing pushrod 22 to move inwardly which, in turn, causes end 26 of rocker arm 24 to also move inwardly while moving end 28 outwardly, which ultimately allows valves 30 and 32 to close. The function of tappet 10 is to convert rotational movement of the camshaft 16 into reciprocating linear movement of pushrod 22 which, in turn, operates valves 30 and 32.

Figure 2:
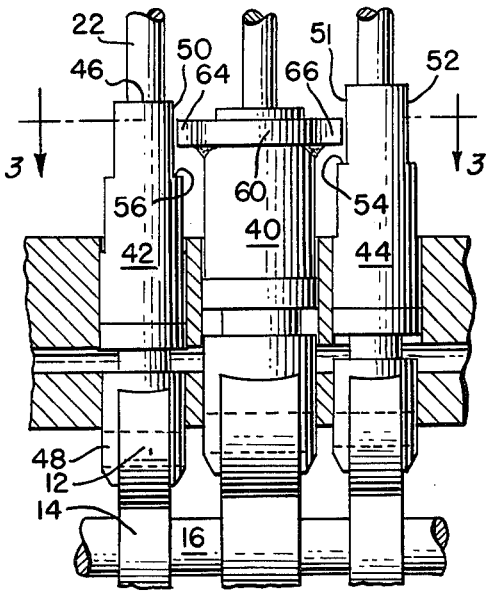
FIG. 2 is a side elevational view of a guide plate designed in accordance with the subject invention in combination with a central injector tappet and two adjacent valve tappets.

FIG. 2 shows a central injector tappet 40 with two valve tappets 42 and 44. Each tappet body has a hollowed upper portion which includes an open end, as at 46 on tappet 42, a solid middle portion, and a bifurcated lower portion, as at 48 on tappet 42. As shown in FIG. 1, open end 46 receives pushrod 22, while bifurcated portion 48 has secured to it roller 12 to engage cam 14. The bodies of tappets 40, 42 and 44 are essentially cylindrical in shape. However, each valve tappet 42 and 44 has been milled to include along its upper end opposed flat guide surfaces 50 and 51 located in parallel planes which are perpendicular with respect to a line extending between the central longitudinal axes of the two valve tappets. The remainder of the length of the valve tappet body has been left with a rounded shape, which results in the formation of a ledge-like structure, as at 54 on tappet 44 and 56 on valve tappet 42, where the rounded and flattened portions of the valve tappet body meet. The tappet guide plate 60 of the present invention is shaped to fit around the circumference of injector tappet 40 and is secured thereto in any suitable conventional manner, such as by welding, brazing or the like. When all three tappets are in their lowest position surfaces 51 and 50 extend sufficiently below the lowermost edge of guide plate 60 to insure that ledges 54 and 56 never come into contact with plate 60 despite the out-of-phase motion of tappets 40, 42 and 44.

Figure 3:
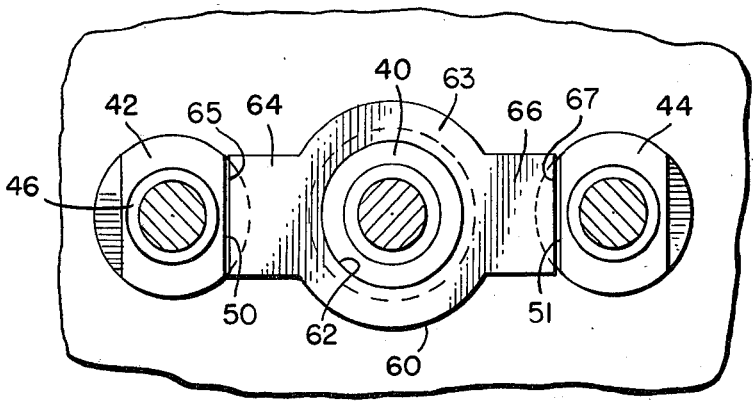
FIG. 3 is a top elevational view of the tappet guide plate illustrated in FIG. 2.
Figure 4:
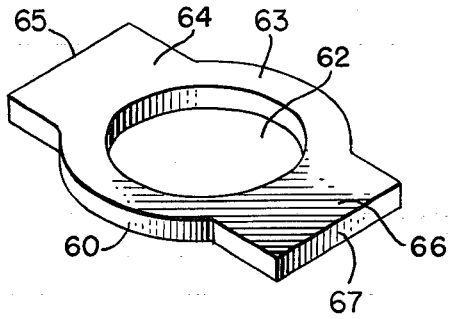
FIG. 4 is a perspective view of the tappet guide plate of this invention.

FIGS. 3 and 4 illustrate the novel tappet guide plate 60 in greater detail. Guide plate 60, as previously mentioned, is shaped to fit around the circumference of injector tappet 40 and to be integrally joined thereto, which means that the tappet guide plate 60 will typically include a circular opening 62 in its central portion 63 approximately equal in diameter to the outer diameter of injector tappet 40. The tappet guide plate 60 further includes opposed squared off extension legs 64 and 66 which, when the guide plate 60 is properly secured to the injector tappet 40, extend toward but terminate short of guide surfaces 50 and 51 of valve tappets 44 and 42, respectively. The outer extremities of extension legs 64 and 66 terminate in a pair of bearing surfaces 65 and 67 formed in planes which are parallel to the planes in which guide surfaces 50 and 51 are formed, respectively. Bearing surfaces 65 and 67 may, thus, be considered bearing surface means for forming a sliding engagement with guide surfaces 50 and 51. Surfaces 65 and 67 are positioned to form a nominal working clearance between the valve tappets and extensions 64 and 66 of tappet guide plate 60 to permit vertical movement of the valve tappets. This clearance, however, is small enough to prevent any significant rotation of the tappets. A clearance of about 0.010 to 0.020 inches between tappet guide surfaces 50 and 51 and bearing surfaces 65 and 67, respectively, has been found effective in preventing rotation while allowing free vertical movement of the valve tappets 42 and 44 independently of the movement of injector tappet 40. The shape and position of tappet guide plate 60 prevents rotation of the injector tappet 40 as well as rotation of the valve tappets 42 and 44 since the tappet guide plate 60 is essentially an integral part of the injector tappet 40. Movement of the injector tappet 40, therefore, is restricted by the proximity of extensions 64 and 66 of tappet guide plate 60 to guide surfaces 50 and 51 of the valve tappets 42 and 44. This arrangement functions to maintain all three tappets in substantial alignment about longitudinal axes though the center of each tappet. Consequently, tappet and cam failures of the type which result from misalignment and rotation of the tappets are avoided.

It should be noted that guide surfaces 50 and 51 are shown in the drawings as being planes. This is definitely the preferred configuration since a flat surface is the least expensive configuration to form from a manufacturing standpoint. However, any surface defined by a set of lines which are parallel to the central longitudinal axis of the respective tappet would be suitable so long as the corresponding bearing surface formed on the guide plate was similarly shaped and would come into immediate contact with the guide surface upon slight rotation of either of the corresponding tappets. A very important advantage of this invention is its simplicity which allows guide plate 60 to be formed from a plate material having substantially uniform thickness with only a minimum number of conventional manufacturing steps.

INDUSTRIAL APPLICABILITY

The tappet guide plate of the present invention finds its primary application in internal combustion engines which have in each cylinder an injector tappet central to intake and exhaust valve tappets. However, it is contemplated that this guide plate is suitable for use in any engine which has three tappets per cylinder. The novel tappet guide is easily and inexpensively machined and readily assembled. Moreover, it may be used to equal advantage to prevent rotation and maintain tappet alignment as a standard part in new engines and as a replacement part in old engines. In either case, use of the novel tappet guide will effectively eliminate or substantially reduce tappet and cam failures caused by tappet rotation or misalignment.

While the present invention has been described with reference to specific embodiments thereof, it will be understood that numerous modifications may be made by those skilled in the art without actually departing from the scope of the claimed invention. Accordingly, all modifications and equivalents may be resorted to which fall within the scope of the invention as claimed.

What is claimed is:

1. Apparatus for preventing tappet rotation for use in an internal combustion engine having first and second tappets mounted for engagement with a camshaft to convert rotational movement of the camshaft into reciprocating linear movement of the tappets along a pair of parallel paths aligned with the central longitudinal axes of the tappets, respectively, the body of the first tappet including a guide surface defined by a set of lines parallel to the longitudinal axis of the first tappet, said apparatus for preventing tappet rotation comprising guide means for preventing rotation of each tappet about its longitudinal axis, said guide means including an extension leg having a length substantially corresponding to the distance between the tappets, attachment means for securing fixedly and integrally one end of said extension leg to the second tappet for causing said extension leg to move with the second tappet in a fixed position relative to the second tappet and extending toward the guide surface of the first tappet and bearing surface means on the other end of said extension leg for forming a sliding engagement with the guide surface of the first tappet, said bearing surface means including a bearing surface located on said other end of said extension leg in a position to provide a nominal working clearance between the guide surface and said bearing surface when the guide means is secured on the second tappet to cause direct engagement of said bearing surface with the guide surface should either tappet rotate slightly about its longitudinal axis.

2. Apparatus as defined in claim 1 for use in an internal combustion engine wherein the guide surface on the first tappet is a flat surface located in a first plane which is perpendicular to a line extending perpendicularly between the longitudinal axes of the first and second tappets and wherein said bearing surface is a flat surface located in a second plane parallel to the first plane when said guide means is secured to the second tappet.

3. Apparatus as defined in claim 1 for use in an internal combustion engine having a third tappet mounted for engagement with the camshaft to convert rotational movement of the camshaft into reciprocating linear movement of the third tappet along a central longitudinal axis parallel to the longitudinal axis of the first and second tappets, the body of the third tappet including a second guide surface defined by a set of lines parallel to the central axes of the third tappet, and wherein said guide means includes a second extension leg having a length substantially corresponding to the distance between the second and third tappets, one end of said second extension leg being integrally connected with said first extension leg to extend toward the additional guide surface on the third tappet when said guide means is secured to the second tappet by said attachment means, said guide means further including second bearing surface means on the other end of said second extension leg for forming a sliding engagement with the second guide surface, said second bearing surface means including a second bearing surface located on said other end of said second extension leg in a position to provide a nominal working clearance between the second guide surface and the second bearing surface when the guide means is secured on the second tappet to cause direct engagement of said second bearing surface with the second guide surface should either the second or third tappet rotate slightly about its longitudinal axis.

4. Apparatus as defined in claim 3, for use in an internal combustion engine wherein the first and second guide surfaces are flat surfaces located in first and third planes, respectively, perpendicular to a pair of lines extending perpendicularly between the longitudinal axes of the first and second tappets and between the longitudinal axes of the second and third tappets, respectively, and wherein said first and second bearing surfaces are flat surfaces located in second and fourth planes parallel to said first and third planes, respectively.

5. Apparatus as defined in claim 4, for use with an internal combustion engine wherein the second tappet is an injector tappet and the first and third tappets are valve tappets and wherein said attachment means includes a central portion connected on one side to said first extension leg and on the other side to said second extension leg, said central portion containing an opening for receiving the body of the injector tappet.

6. Apparatus as defined in claim 5, wherein said first and second extension legs and said central portion together define a plate-like member having substantially constant thickness.

7. Apparatus as defined in claim 5 for use with an internal combustion engine wherein the longitudinal axes of the first, second and third tappets are positioned in a common plane and said first, second, third and fourth planes are parallel when said guide means is secured to the second tappet.

8. An internal combustion engine comprising:

(a) a rotatable camshaft;

(b) first and second tappets mounted for engagement with said camshaft to convert rotational movement of the camshaft into reciprocating linear movement of said tappets along a pair of parallel paths aligned with the central longitudinal axes of the tappets, respectively, the body of said first tappet including a guide surface defined by a set of lines parallel to the longitudinal axis of said first tappet; and (c) guide means for preventing rotation of each said tappet about its longitudinal axis, said guide means including:

(1) an extension leg having a length substantially corresponding to the distance between said tappets, (2) attachment means for securing fixedly and integrally one end of said extension leg to said second tappet for causing said extension leg to move with said second tappet in a fixed position relative to said second tappet and extending toward said guide surface of said first tappet, and (3) bearing surface means on the other end of said extension leg for forming a sliding engagement with said guide surface of said first tappet, said bearing surface means including a bearing surface located on said other end of said extension leg in a position to provide a nominal working clearance between said guide surface and said bearing surface when said guide means is secured on said second tappet to cause direct engagement of said bearing surface with said guide surface should either tappet rotate slightly about its longitudinal axis.

9. An internal combustion engine as defined in claim 8, wherein said guide surface on said first tappet is a flat surface located in a first plane which is perpendicular to a line extending perpendicularly between the longitudinal axes of said first and second tappets and wherein said bearing surface is a flat surface located in a second plane parallel to said first plane when said guide means is secured to said second tappet.

10. An internal combustion engine as defined in claim 8, further including a third tappet mounted for engagement with said camshaft to convert rotational movement of the camshaft into reciprocating linear movement of said third tappet along a central longitudinal axis parallel to said longitudinal axis of said first and second tappets, the body of said third tappet including a second guide surface defined by a set of lines parallel to the central axes of said third tappet, and wherein said guide means includes a second extension leg having a length substantially corresponding to the distance between said second and third tappets, one end of said second extension leg being integrally connected with said first extension leg to extend toward said additional guide surface on said third tappet when said guide means is secured to said second tappet by said attachment means, said guide means further including second bearing surface means on the other end of said second extension leg for forming a sliding engagement with said second guide surface, said second bearing surface means including a second bearing surface located on said other end of said second extension leg in a position to provide a nominal working clearance between said second guide surface and said second bearing surface when said guide means is secured on said second tappet to cause direct engagement of said second bearing surface with said second guide surface should either said second or said third tappet rotate slightly about its longitudinal axis.

11. An internal combustion engine as defined in claim 10, wherein said nominal working clearance is in the range of 0.01 to 0.02 inches.

12. An internal combustion engine as defined in claim 10, wherein said first and second guide surfaces are flat surfaces located in first and third planes, respectively, perpendicular to a pair of lines extending perpendicularly between the longitudinal axes of said first and second tappets and between the longitudinal axes of said second and third tappets, respectively, and wherein said first and second bearing surfaces are flat surfaces located in second and fourth planes parallel to said first and third planes, respectively.

13. An internal combustion engine as defined in claim 12, wherein said second tappet is an injector tappet and said first and third tappets are valve tappets and wherein said attachment means includes a central portion connected on one side to said first extension leg and on the other side to said second extension leg, said central portion containing an opening for receiving the body of said injector tappet.

14. An internal combustion engine as defined in claim 13, wherein the longitudinal axes of said first, second and third tappets are positioned in a common plane and said first, second, third and fourth planes are parallel when said guide means is secured to said second tappet.

15. An internal combustion engine as defined in claim 13, wherein said first and second extension legs and said central portion together define a plate-like member having substantially constant thickness.

* * * * *